US006267271B1

(12) United States Patent
Tsuchida et al.

(10) Patent No.: US 6,267,271 B1
(45) Date of Patent: Jul. 31, 2001

(54) TRIGGER-TYPE LIQUID DISPENSER

(75) Inventors: Haruo Tsuchida; Hiroyuki Nakamura, both of Tokyo (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 0 days.

(21) Appl. No.: 09/446,456

(22) PCT Filed: Apr. 30, 1999

(86) PCT No.: PCT/JP99/02330

§ 371 Date: Dec. 22, 1999

§ 102(e) Date: Dec. 22, 1999

(87) PCT Pub. No.: WO99/56886

PCT Pub. Date: Nov. 11, 1999

(30) Foreign Application Priority Data

May 1, 1998 (JP) ..... 10-137511
Aug. 4, 1998 (JP) ..... 10-232349

(51) Int. Cl.[7] ..... B67D 5/40
(52) U.S. Cl. ..... 222/383.1
(58) Field of Search ..... 222/382, 383.1, 222/340; 239/333

(56) References Cited

U.S. PATENT DOCUMENTS 5,341,965 * 8/1994 Mass et al. ..... 222/383.1
5,423,460 6/1995 Thomann .
5,564,604 * 10/1996 Tada ..... 222/383.1
5,706,984 * 1/1998 Tada et al. ..... 222/383.1

FOREIGN PATENT DOCUMENTS 6-502701 3/1994 (JP) .
2-2577228 5/1998 (JP) .

* cited by examiner

*Primary Examiner*—Philippe Derakshani
(74) *Attorney, Agent, or Firm*—Oliff & Berridge, PLC

(57) ABSTRACT

A spring member (6) is made of synthetic resin, and comprises a base plate (12) and a pair of spring pieces (29) for returning the plunger (5). Each of said spring pieces (29) comprises a main plate spring (32), a second plate spring (33) and a lower end (30). Said main plate spring (32) is positioned at plunger side, and has a schematically arcuate longitudinal section. Said second plate spring (33) is positioned at nozzle head side, and has a longitudinal section constituting a substantially constant-load plate spring. Said main plate spring (32) and said second plate spring (33) are connected each other at an upper end and a lower end (30) thereof. A locus of elastic deformation of the main plate spring (32) substantially coincides with an arc locus (Y, Z) including a tangent line (X) in an upper surface of the base plate (12).

8 Claims, 12 Drawing Sheets

TRIGGER-TYPE LIQUID DISPENSER

BACKGROUND OF THE INVENTION

The present invention relates to a trigger-type liquid dispenser. More particularly, the present invention relates to a spring member made of synthetic resin in the trigger-type liquid injector, and a rotational mechanism of a nozzle head.

There are a lot of disclosure of a synthetic resin trigger-type liquid dispenser or injector for atomizing, injecting and injecting in the form of foaming.

Such known trigger-type liquid dispenser comprises an injector body having an inverted L-shaped side shape, a nozzle head mounted at a front end of the injector body, a trigger hinged at a front portion of the injector body, a pump mechanism in the injector body, said pump mechanism including a plunger, and a coil spring for returning the plunger, which spring is made of metal. A cover is mounted outside of the injector body. The injector body includes a mounting cylinder and a suction pipe at its lower end. The trigger liquid dispenser is mounted to a neck of a container storing liquid at the mounting cylinder. The suction pipe is inserted into the container. When the trigger is pulled, the pump mechanism sucks liquid from the container to the nozzle head, through which the liquid is atomized, injected, or injected in the form of foaming, etc.

Recently, it is required to reuse waste products as resources with the increase of waste products, and therefore a spring member made of synthetic resin has been proposed. However, the conventional spring member made of synthetic resin has the following disadvantages.

If a spring constant is uniform in whole of the spring member, it tends to concentrate an internal stress to a portion at which the spring member is fixed to the injector body. Thus, when the trigger is used above the setting times, there is a possibility of fatigue breakage. If a spring constant is uniform, internal stress is uniformly dispersed. Thus, if a spring constant varies gradually, a required spring elasticity may not be obtained, or an operating power is required too much.

SUMMARY OF THE INVENTION

Therefore, it is the object of the present invention to prevent the internal stress from concentrating. In order to achieve the object, a locus of an elastic deformation is set to be an arc locus having a constant tangent line, and to decrease a diameter of locus gradually. Because of such locus of an elastic deformation, when a spring is returned to the original, an insufficient spring elasticity can be compensated by rebound resilience of substantially constant-load plate spring. In addition, a soft and tough operating feeling can be obtained. Further, spring member can be easily assembled, the assembled spring member is securely fixed.

In order to solve the above-described object, according to the present invention, provided is a trigger-type liquid dispenser comprising an injector body having an inverted L-shaped side shape, a nozzle head mounted at a front end of the injector body, a trigger hinged at a front portion of the injector body, a pump mechanism in the injector body, said pump mechanism including a plunger, and a spring member; characterized in that the spring member is made of synthetic resin, and comprises a base plate and a pair of spring pieces for returning the plunger; each of said spring pieces comprises a main plate spring, a second plate spring and a lower end; said main plate spring is positioned at nozzle head side, and has a schematically arcuate longitudinal section; said second plate spring is positioned at plunger side, and has a longitudinal section constituting a substantially constant-load plate spring; said main plate spring and said second plate spring are connected each other at an upper end and a lower end thereof; and a locus of elastic deformation of the main plate spring substantially coincides with an arc locus including a tangent line in an upper surface of the base plate.

Preferably, fit fixing means are provided between the base plate of the spring member and receiving seats provided on the injector body, so as to fix the base plate with the injector body. In addition, preferably, the trigger is provided with a pair of pockets at a middle portion of both right and left sides of the trigger, and each of the lower ends of the spring pieces of the spring member is inserted into each of the pockets. According to such construction, the trigger-type liquid dispenser can be easily assembled by only inserting the base plate of the spring member into the receiving seats of the injector body and by inserting the lower ends of the springs pieces to the pockets of the trigger, so that assembling is easy and the spring member is surely fixed to the injector body and the trigger.

More preferably, the front receiving seat is formed on an upper surface of the tip member, and the rear receiving seat is formed on an upper surface of a rear portion of the injection cylinder. According to such construction, the trigger-type liquid dispenser can be easily and quickly assembled.

Still preferably, the tip member may be integrally formed with a front portion of the base plate. According to such construction, the trigger-type liquid dispense can be further quickly assembled, because the step for engaging the front portion of the base plate with the tip member is omitted.

According to another aspect of the invention, the nozzle head is provided with fitting portions on an inner surface thereof, the tip member is provided with a fitting projection extending radially and outwardly, and the fitting projection is engaged with the fitting portions. Each of said fitting portions comprises a pair of fitting convex strips. According to such construction, since the fitting projection of the tip member is engaged with the fitting portion of the nozzle head, the nozzle head can be precisely positioned with the tip member.

PREFERRED EMBODIMENTS OF THE INVENTION

Figure 1:
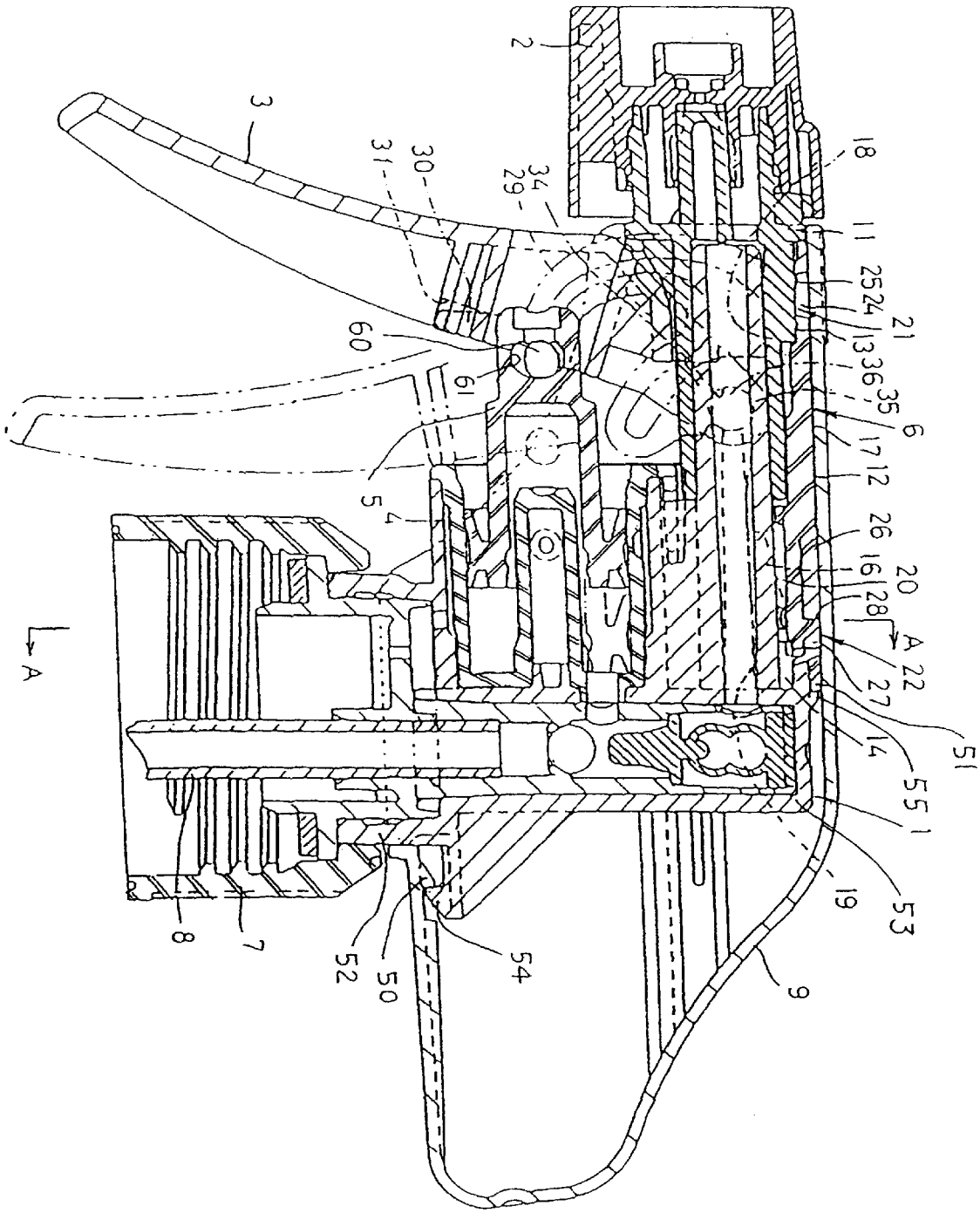
FIG. 1 is a longitudinal sectional side view showing a trigger type liquid dispenser including the spring member according to the present invention.

FIGS. 1–15 show an embodiment of the spring member made of synthetic resin according to the present invention.

The trigger type liquid dispenser includes am injector body 1 having an inverted L-shape, a tip member 11 provided at a front end of the injector body 1, a nozzle head 2 provided at a front end of the tip member 11, a trigger 3 hinged at a position of a front portion of the injector body 1, a reciprocating pump mechanism 4 provided in the injector body 1, a spring member 6 provided on an upper surface of the injector body 1 and outside of the trigger 3, a mounting cylinder 7, a suction pipe 8, a cover 9 provided outside of the injector body 1. In the illustrated embodiment, the nozzle head 2 can change the injected form of the liquid, such as atomizing, injecting or injecting in the form of foaming, however, the present invention is not limited to the illustrated embodiment. The pump mechanism 4 includes a plunger 5 which is reciprocated by the trigger 3. The spring member 6 urges the trigger 3 and the pump mechanism 4 forwardly. The mounting cylinder 7 is rotatably attached to a lower end portion of the injector body 1 and has threads in its inner surface. These elements are made of synthetic resin.

As illustrated in FIGS. 7–12, the spring member 6 comprises a base plate 12 horizontally arranged and a pair of spring pieces 29. The base plate 12 includes a top wall 17, ribs 18, 19, 20 protruded downwardly from both sides of the top wall 17, a pair of engaging pawls 23, a latching pawl 28 and a window 24. Each of the spring pieces 29 comprises a main plate spring 32, a second plate spring 33 and a lower end 30, and includes a shaft-receiving portion 34.

The relationship between the injector body 1 and the nozzle head 2 will be explained in more detail. The injector body 1 includes the injection cylinder 10 at its front end portion. The injection cylinder 10 is attached with the tip member 11. In view of the difficulties of the molding of the injector body 1, the tip member 11 is attached. The nozzle head 2 is attached to the injector body 1 through the tip member 11.

Figure 6:
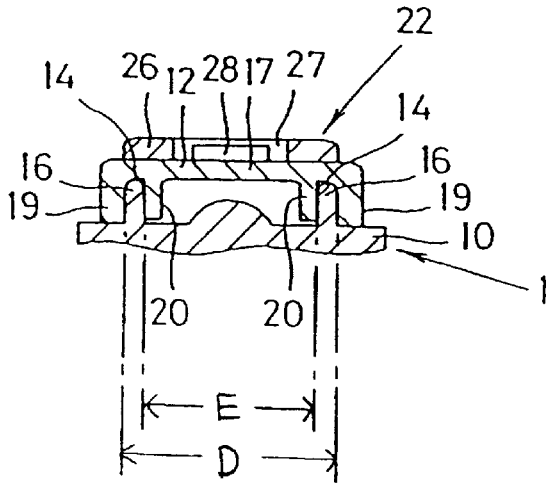
FIG. 6 is a sectional view of the main portions taken along the line A—A of FIG. 1.
Figure 7:
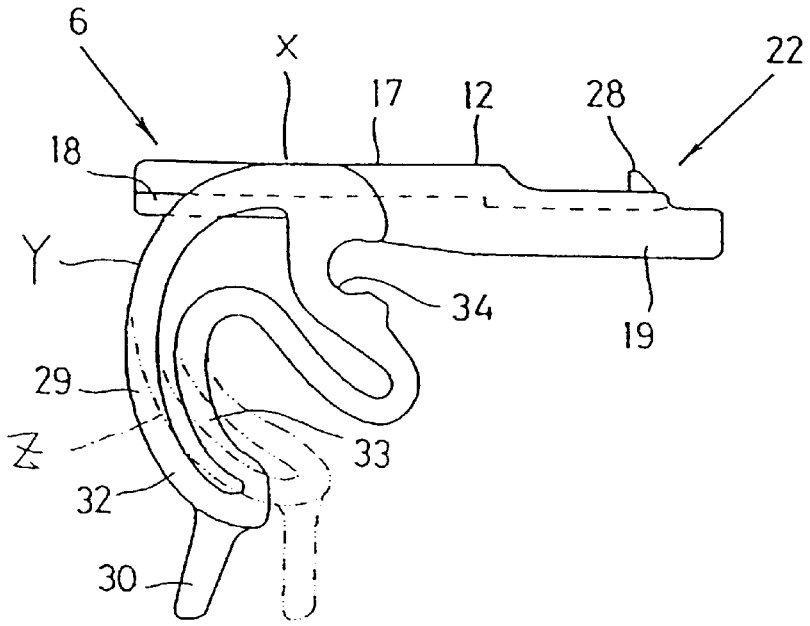
FIG. 7 is a side view of the spring member of the trigger type liquid dispenser illustrated in FIG. 1.
Figure 8:
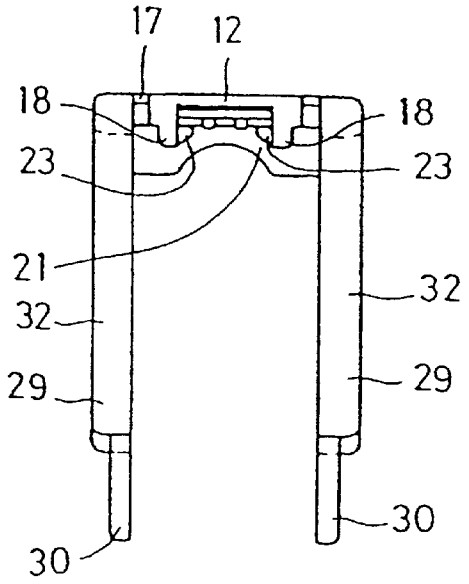
FIG. 8 is a front view of the spring member of the trigger type liquid dispenser illustrated in FIG. 1.
Figure 9:
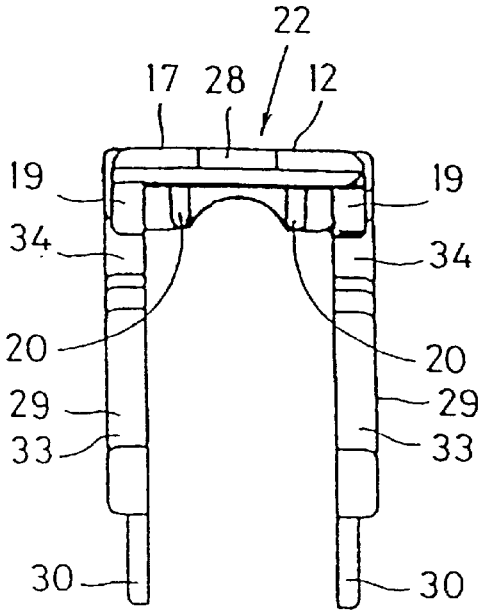
FIG. 9 is a rear view of the spring member of the trigger type liquid dispenser illustrated in FIG. 1.
Figure 13:
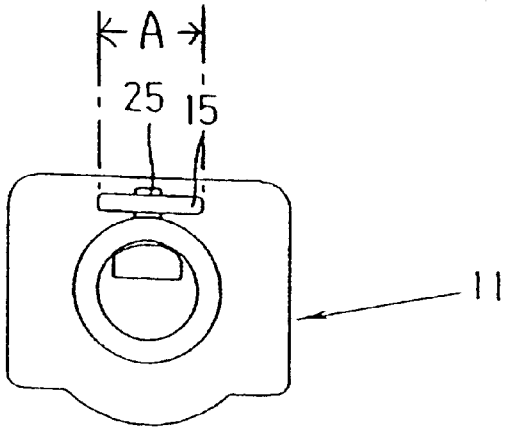
FIG. 13 is a front view of the tip member of the trigger type liquid dispenser illustrated in FIG. 1.

The relationship between the injector body 1 and the spring member 6 will be explained in more detail. A front portion and a rear portion of an upper surface of the injector body 1 are provided with receiving seats 13, 14, respectively, for receiving the base plate 12 of the spring member 6. The front receiving seat 13 is formed by a narrow horizontal piece 15 which is integrally formed with the tip member 11, and has a width A (FIG. 13). The rear receiving seat 14 is formed by two longitudinal strips 16, 16 extending parallel with a space wider than the horizontal piece 15 (FIG. 6). As illustrated in FIG. 6, a width between an outer surface of one of the strips 16 and an outer surface of the other of the strips 16 is D, and a width between an inner surface of one of the strips 16 and an inner surface of the other of the strips 16 is E.

Figure 5:
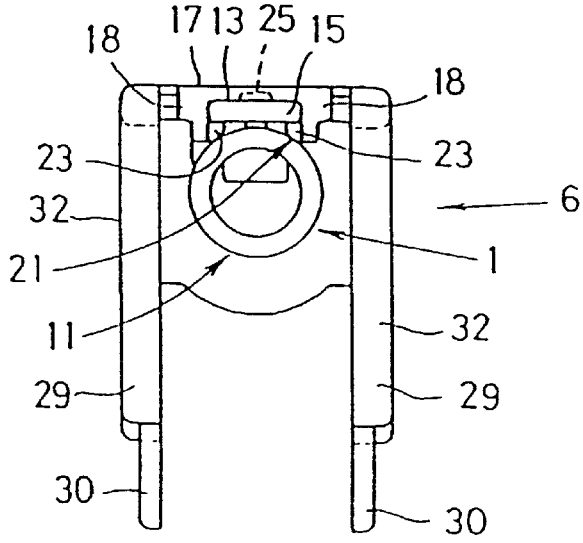
FIG. 5 is a front view of the assembled state of the spring member and the tip member of the trigger type liquid dispenser of FIG. 1.
Figure 10:
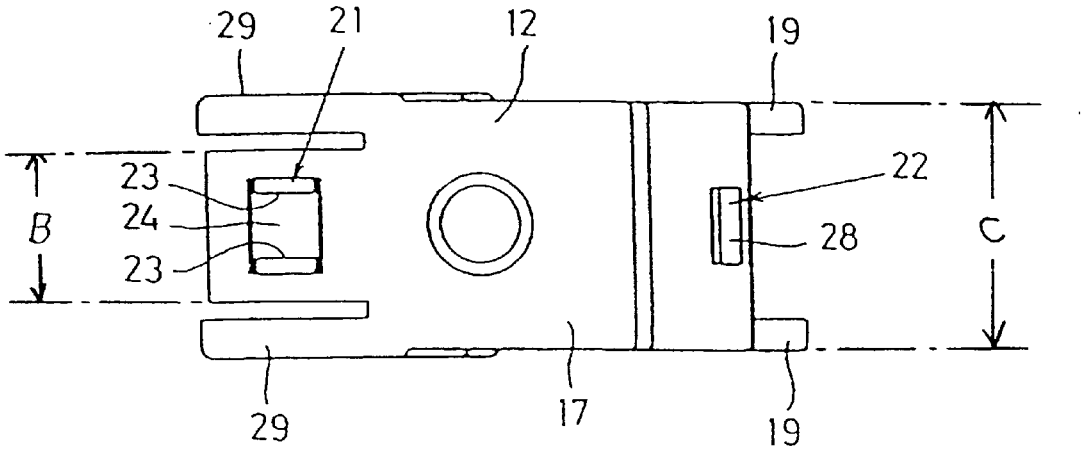
FIG. 10 is a top view of the spring member of the trigger type liquid dispenser illustrated in FIG. 1.

The spring member 6 is a kind of plate springs made of synthetic resin. As described above, the spring member 6 has the horizontal base plate 12 to be fixed with the receiving seats 13, 14. More particularly, a front end of the base plate 12 is fixed to the receiving seat 13, and a rear end of the base plate 12 is fixed to the receiving seat 14. The base plate 12 has the top wall 17. A front portion of the top wall 17 has a narrow width B, and a rear portion of the top wall 17 has a wide width C, as illustrated in FIG. 10. The top wall 17 is provided with a pair of ribs 18, 18 on a lower surface of the front portion thereof. The two ribs 18, 18 are arranged with a space corresponding to the width A of the horizontal piece 15. Thus, when assembled, the horizontal piece 15 is fitted between two ribs 18, 18, as illustrated in FIG. 5. In other words, each of the ribs 18, 18 of the spring member 6 is engaged with an outer surface of the horizontal piece 15 of tip member 11. The top wall 17 is also provided with a pair of ribs 19, 19 on a lower surface of the rear portion thereof. As illustrated in FIG. 6, the two ribs 19, 19 are arranged with a space corresponding to the width D between the outer surfaces of the longitudinal strips 16, 16 of the injector body 1. The top wall 17 is further provided with a pair of ribs 20, 20 on the lower surface of the rear portion thereof. The two ribs 20, 20 are arranged with a space corresponding to the width E between the inner surfaces of the longitudinal strips 16, 16 of the injector body 1. When assembled, each of the longitudinal strips 16, 16 is inserted between the rib 19 and the rib 20 of the spring member 6. In other words, each of the ribs 19, 19 of the spring member 6 is engaged with the outer surface of the longitudinal strip 16 of the injection body 1, and each of the ribs 20, 20 of the spring member 6 is engaged with the inner surface of the longitudinal strip 16 of the injection body 1.

Figure 2:
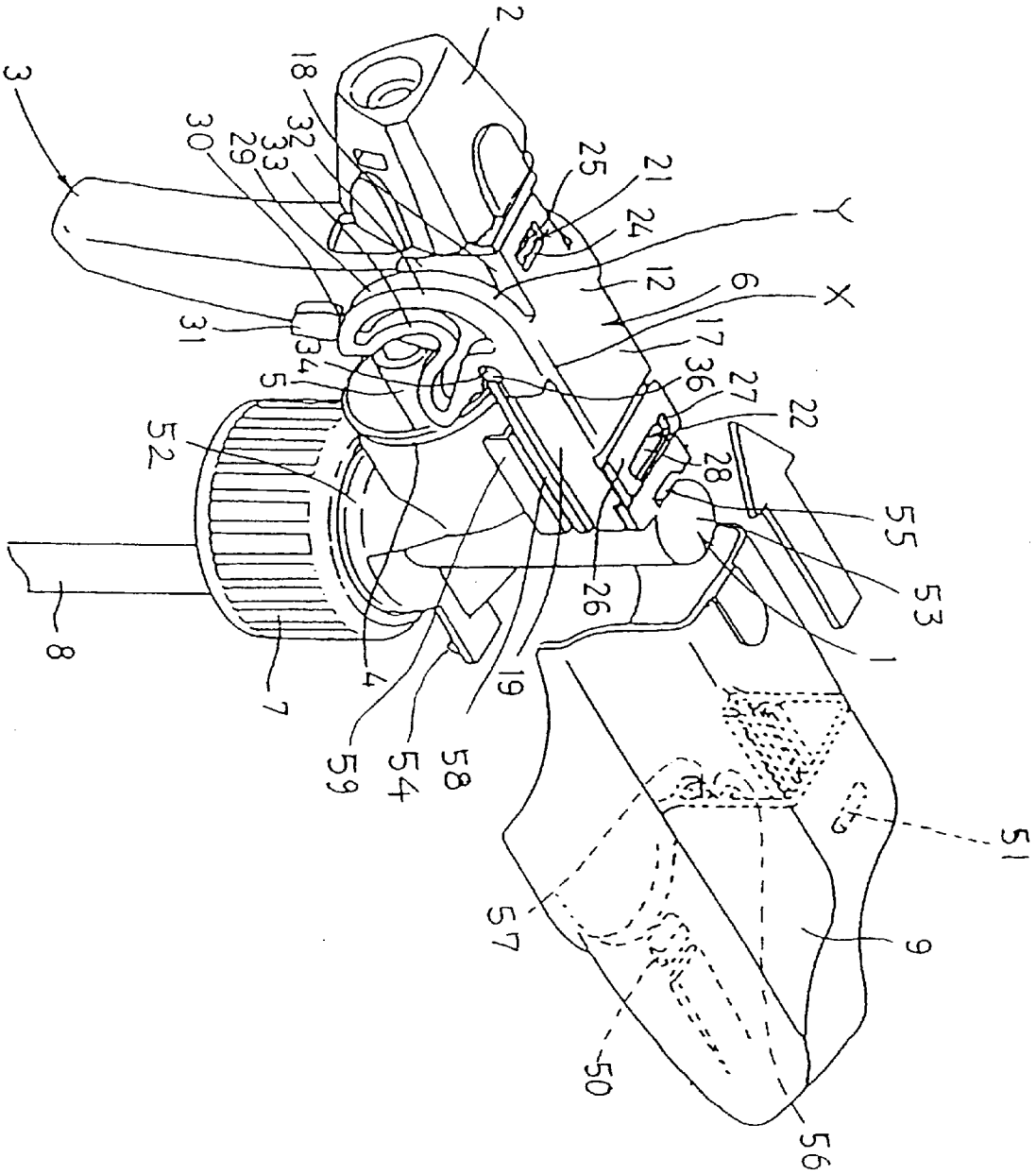
FIG. 2 is an perspective view of the disassembled state of the trigger type liquid dispenser of FIG. 1 without the cover.
Figure 3:
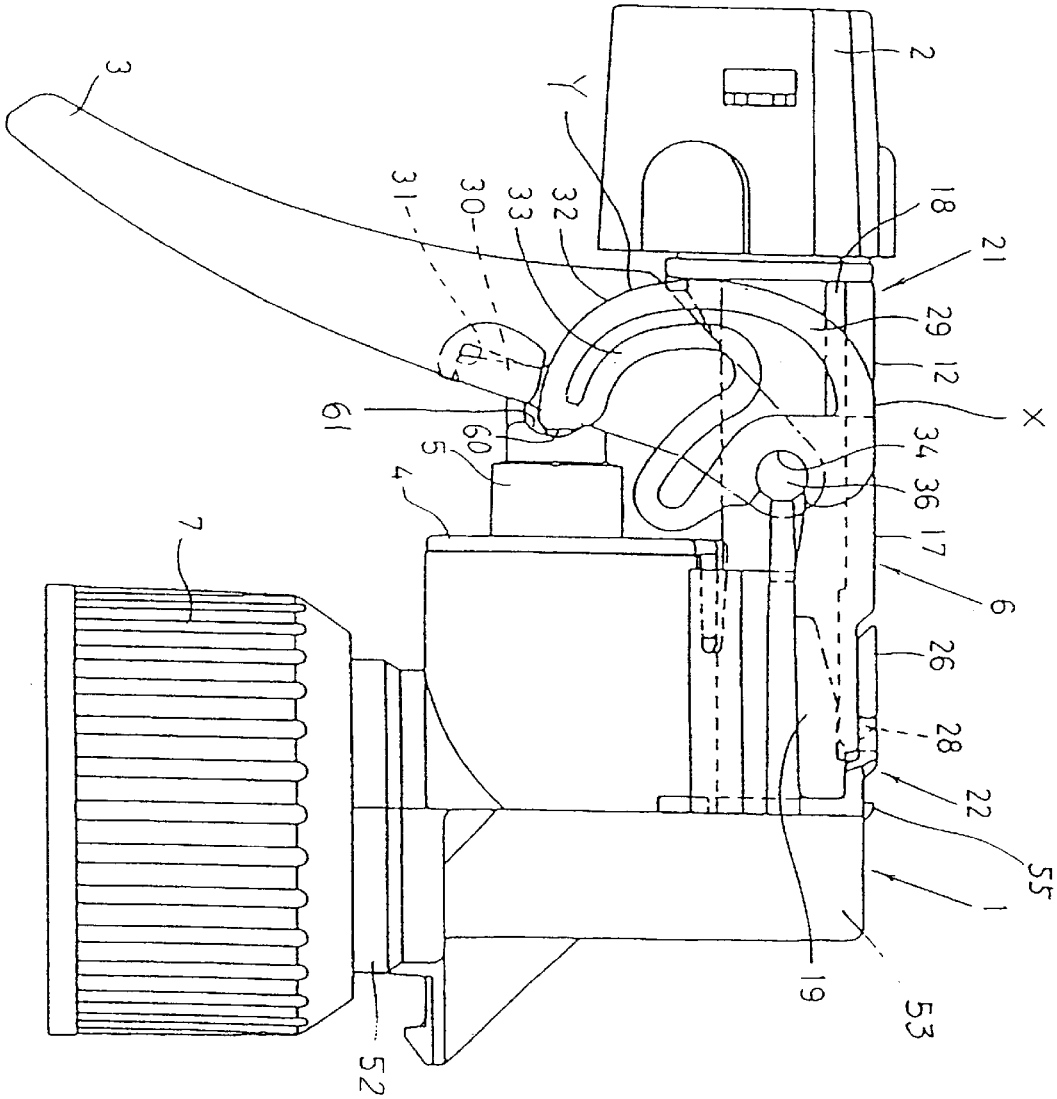
FIG. 3 is a side view of the trigger type liquid dispenser of FIG. 1 without a cover.
Figure 11:
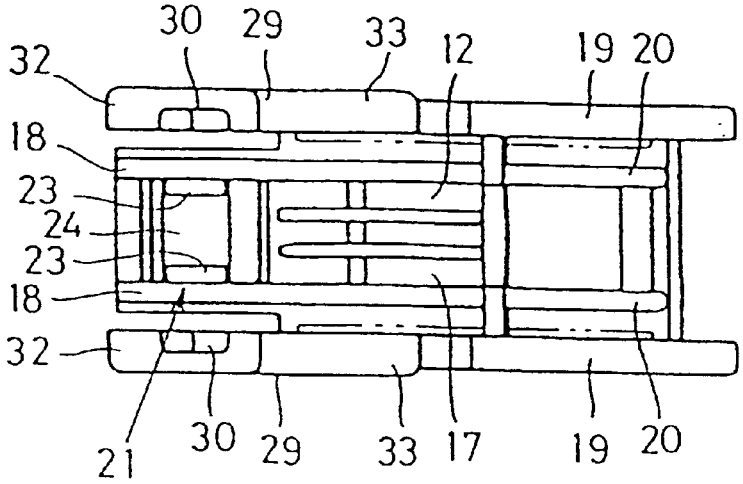
FIG. 11 is a bottom view of the spring member of the trigger type liquid dispenser illustrated in FIG. 1.
Figure 12:
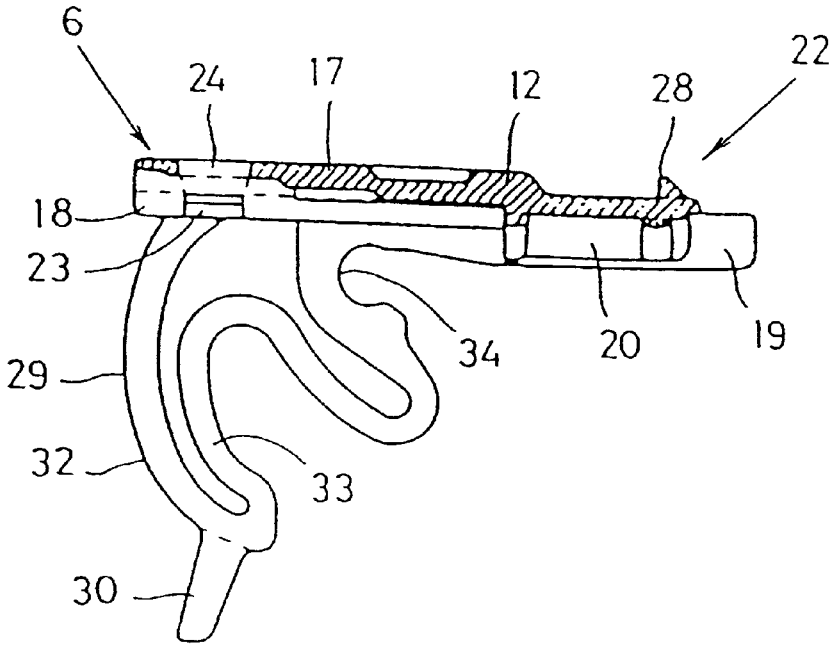
FIG. 12 is a central longitudinal sectional side view of the spring member of the trigger type liquid dispenser illustrated in FIG. 1.
Figure 14:
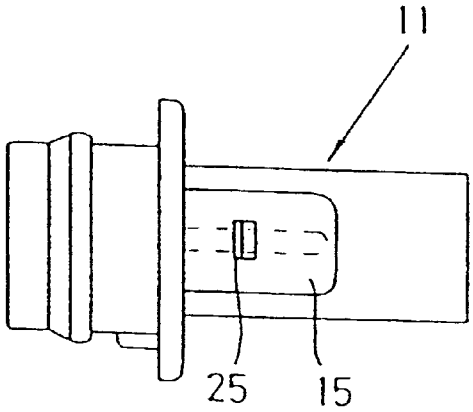
FIG. 14 is a top view of the tip member of the trigger type liquid dispenser illustrated in FIG. 1.

Between the receiving seat 13 of the tip member 11 and the base plate 12 of the spring member 6, and between the receiving seat 14 of the injection body 1 and the base plate 12 of the spring member 6, fit-fixing means 21, 22 are further provided. The fit-fixing means 21 comprises engaging pawls 23, the horizontal piece 15, a first window 24 and a first latching pawl 25. Each of the engaging pawls 23 is formed on an inner surface of the front portion of the rib 18 of the base plate 12. Each of the engaging pawls 23 is engaged onto a lower surface of the horizontal piece 15, as illustrated in FIG. 5. The first window 24 is provided at the front portion of the top wall 17 of the base plate 12, as illustrated in FIGS. 10–12. The first latching pawl 25 is provided on an upper surface of the horizontal piece 15 of the tip member 11, as illustrated in FIGS. 13 and 14. The first latching pawl 25 of the tip member 11 is engaged to a front edge of the first window 24 of the spring member 6. The fit-fixing means 22 comprises a holding piece 26, the top wall 17, a second window 27 and a second latching pawl 28. The holding piece 26 is formed above an upper surface of the injection cylinder 10 of the injector body 1 as illustrated in FIGS. 1–3, and engages with the top wall 17 so as to prevent the spring member 6 from moving upwardly. The holding piece 26 of the injector body 1 is provided with the second window 27. The second latching pawl 28 is formed on an upper surface of the rear portion of the top wall 17 of the spring member 6. The second latching pawl 28 is engaged with a front edge of the second window 27. Note that the present invention is not limited to the illustrated embodiment.

As described above, the spring member 6 comprises the base plate 12 and a pair of spring pieces 29, and each of the spring pieces 29 comprises the main plate spring 32, the second plate spring 33 and the lower end 30, and includes a shaft-receiving portion 34. Each of the spring pieces 29 made of synthetic resin is suspended or extended downwardly from the front portion of the base plate 12. Each of the spring pieces 29 comprises the main plate spring 32 at the front side (the nozzle head 2 side) and the second plate spring 33 at the rear side (the plunger 5 side), which are connected in one at the lower end 30. The lower end 30 can be inserted into an upward pocket 31 provided at a middle portion of both sides of the trigger 3, and is slidably movable in the pocket 31. Each of the second plate spring 33 has C-shape at its upper portion 34 which acts as a shaft-receiving portion. More particularly, the shaft-receiving portion 34 is provided at the upper portion of the second plate spring 33, which upper portion is connected to the base plate 12. The trigger 3 is forked at its upper end portion 35, which is provided with a cantilever shaft 36. The cantilever shaft 36 of the trigger 3 is inserted into the C-shaped upper portion 34 of the spring member 6, so that the trigger 3 can be pulled and returned around the shaft 36.

The following is an explanation how to assemble the spring member 6 with the injector body 1 and the tip member 11, in other words, to attach the base plate 12 of the spring member 6 to the upper surface of the injection cylinder 10 of the injector body 1 and to the upper surface of the tip member 11. First, the rear portion of the base plate 12 is inserted from forward slightly obliquely above into under the holding piece 26 of the injector body 1. In this case, the second latching pawl 28 of the spring member 6 is engaged with the front edge of the second window 27 of the injector body 1 as illustrated in FIGS. 2 and 3. Also, the rear portion of the base plate 12 of the spring member 6 is seated in the rear receiving seat 14 of the injector body 1, in other words, the longitudinal strips 16, 16 of the injection cylinder 10 of the injector body 1 is inserted between the ribs 19 and ribs 20 of the spring member 6 as illustrated in FIG. 6. Next, the front portion of the base plate 12 of the spring member 6 is pushed downwardly, so that the front portion of the base plate 12 is seated to the front receiving seat 13 of the tip member 11. In other words, the engaging pawls 23, 23 of the spring member 6 go beyond the horizontal piece 15 of the tip member 11 due to the elasticity of the synthetic resin, and are engaged with the lower surface of the horizontal piece 15, as illustrated in FIG. 5. The horizontal piece 15 of the tip member 11 is inserted between ribs 18, 18 of the spring member 6. The first latching pawl 25 of the tip member 11 is engaged with the front edge of the first window 24 of the spring member 6.

Thereafter, the cantilever shaft 36 of the trigger 3 is inserted into the shaft-receiving portion 34 of the spring member 6, and the lower end 30 of the spring member 6 is inserted into the pocket 31 of the trigger 3.

The procedure of the assembling is not limited to the above described method, and the order thereof may be changed.

When the trigger 3 is pulled, rearward and upward force derived from the spring pieces 29 is applied to the base plate 12 of the spring member 6 assembled as described above. Since the base plate 12 is secured stably and strongly on the upper surface of the injector body 1, the base plate 12 applies reaction force to the spring pieces 29, so that the spring pieces 29 exhibit strong elastic force properly. When the trigger 3 is released, the spring pieces 29 properly urge trigger 3 and the plunger 5 of the pump mechanism 4 forwardly. As described above, each of the spring peaces 29 comprises the main plate spring 32 and the second plate spring 33. Thus, when the trigger 3 is pulled, elastic deformation of bending occurs in the main plate spring 32 and the second plate spring 33, bending stress (compressive stress and tensile stress) is applied to both the main plate spring 32 and the second plate spring 33, and particularly bending stress is applied to a wide area including the bent portion of the middle of the second plate spring 33 (in FIG. 15, tensile stress and compressive stress are applied to the dotted portion). Since the bending stress is dispersed to the wide area as described above, when the trigger 3 is returned, the second plate spring 33 returns to the original state gradually, so as to obtain soft feeling of returning of the trigger.

Figure 15:
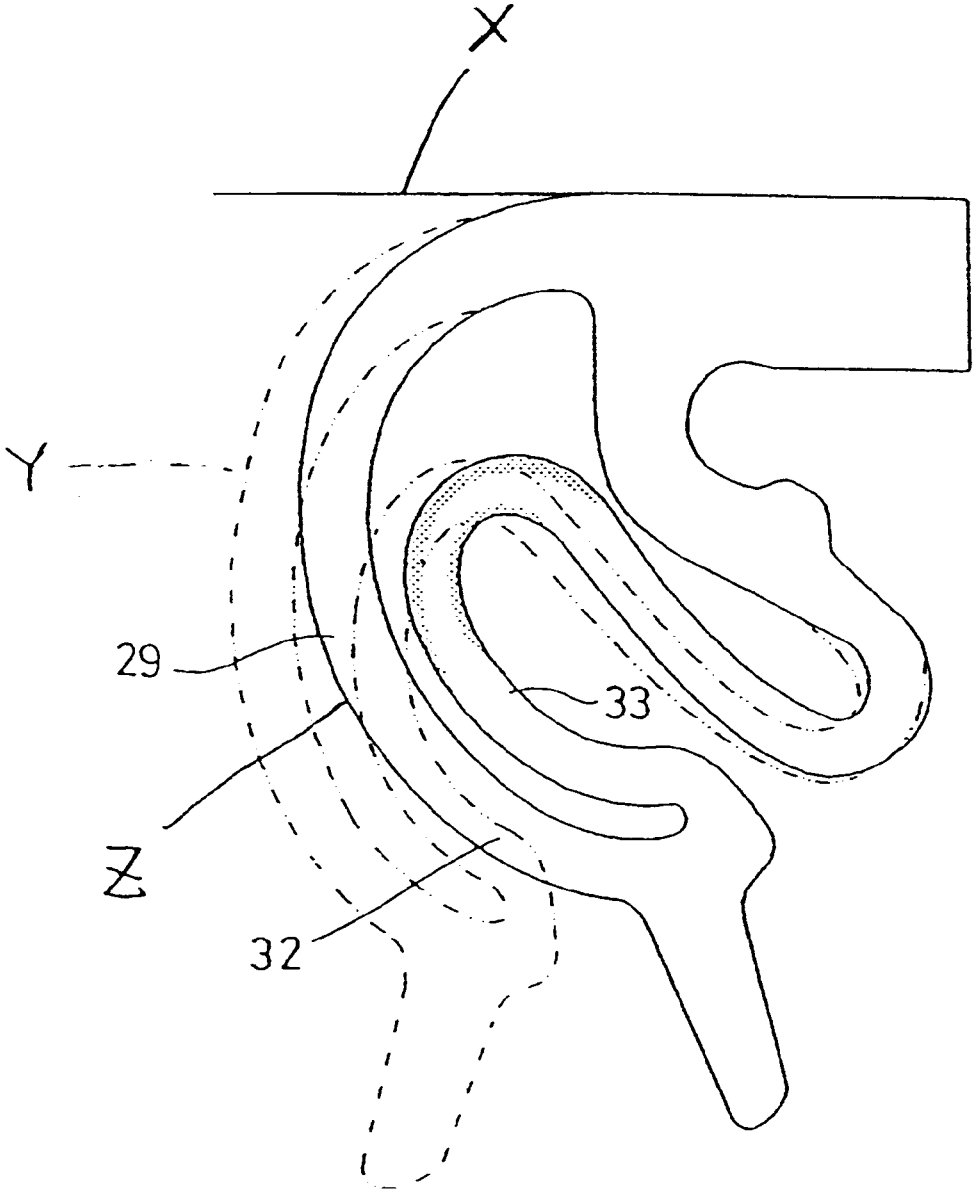
FIG. 15 is an illustrating side view showing the actuating states of the spring pieces.

The main plate spring 32 is disposed on the outside (which is the nozzle head 2 side) with respect to the plunger 5. The main plate spring 32 has a schematically arcuate longitudinal section. As illustrated in FIG. 15, the locus of the elastic deformation of the main plate spring 32 due to the reciprocating movement of the trigger 3 substantially coincides with the arc loci Y and Z. Each of the arc locus Y and the arc locus Z includes a tangent line X in the upper surface of the top wall 17 of the base plate 12. The main plate spring 32 is elastically deformed between the arc locus Y and the arc locus Z. Thus, the internal stress occurred in the main plate spring 32 due to the elastic deformation is dispersed uniformly in whole portion of the main plate spring 32, and such internal stress is not concentrated in a part.

The second plate spring 33 is disposed on the plunger 5 side. The second plate spring 33 has a longitudinal section which constitutes a constant force plate spring. In the illustrated embodiment, the second plate spring 33 includes an inverted S-shaped portion between the upper end (connected to the main plate spring 32) and the lower end 30 (connected to the main plate spring 32). In such illustrated embodiment, even if bending degree of the inverted U-shape bent portion disposed in the center of the second plate spring 33 varies gradually due to the elastic deformation of the main plate spring 32 at the time of pulling the trigger 3, load transmitted from the ends of the second plate spring 33 to the main plate spring 32 is maintained constantly throughout the elastic deformed status of the second plate spring 33.

In the second plate spring 33, bending degree varies continuously or gradually. The internal stress (or the bending stress) is dispersed in the portion including both sides of the inflection point of the inverted U-shaped bent portion, and is not concentrated in a part. When the trigger 3 returns, the bending degree is gradually decreased, and the load is uniformly transmitted from the second plate spring 33 to the upper and lower ends of the main plate spring 32. Thus, the elastic force of the spring pieces 29 to the plunger 5 of the pump mechanism 4 is uniformly from the beginning of the bending of the second plate spring 33 to the end of the bending of the second plate spring 33.

In the illustrated embodiment, the second plate spring 33 is preferably a S-shape snaking spring or rectangular snaking spring etc. as a constant force plate spring. However, the present invention is not limited to such shape of the second plate spring 33 as described above.

Relating to the cover 9, the cover 9 is provided with engaging projections 50 and 51 in its inner surface, as illustrated in FIGS. 1 and 2. The injector body 1 includes a base portion 52 and a top portion 53, as illustrated in FIGS. 1–3. The base portion 52 is provided with an engaging projection 54. The top portion 53 is provided with an engaging projection 55. The engaging projection 50 of the cover 9 is engaged with the engaging projection 54 of the injector body 1, and the engaging projection 51 of the cover 9 is engaged with the engaging projection 55 of the injector body 1. Also, the cover 9 is provided with an engaging lateral recesses 56 and 57 in its inner surface as illustrated in FIG. 2. The injector body 1 is provided with engaging convex strips 58 and 59 on its right and left sides. The engaging lateral recesses 56 and 57 of the cover 9 are engaged with the engaging convex strips 58 and 59 of the injector body 1. Due to the above described constructions, the cover 9 is secured to the injector body 1.

Figure 4:
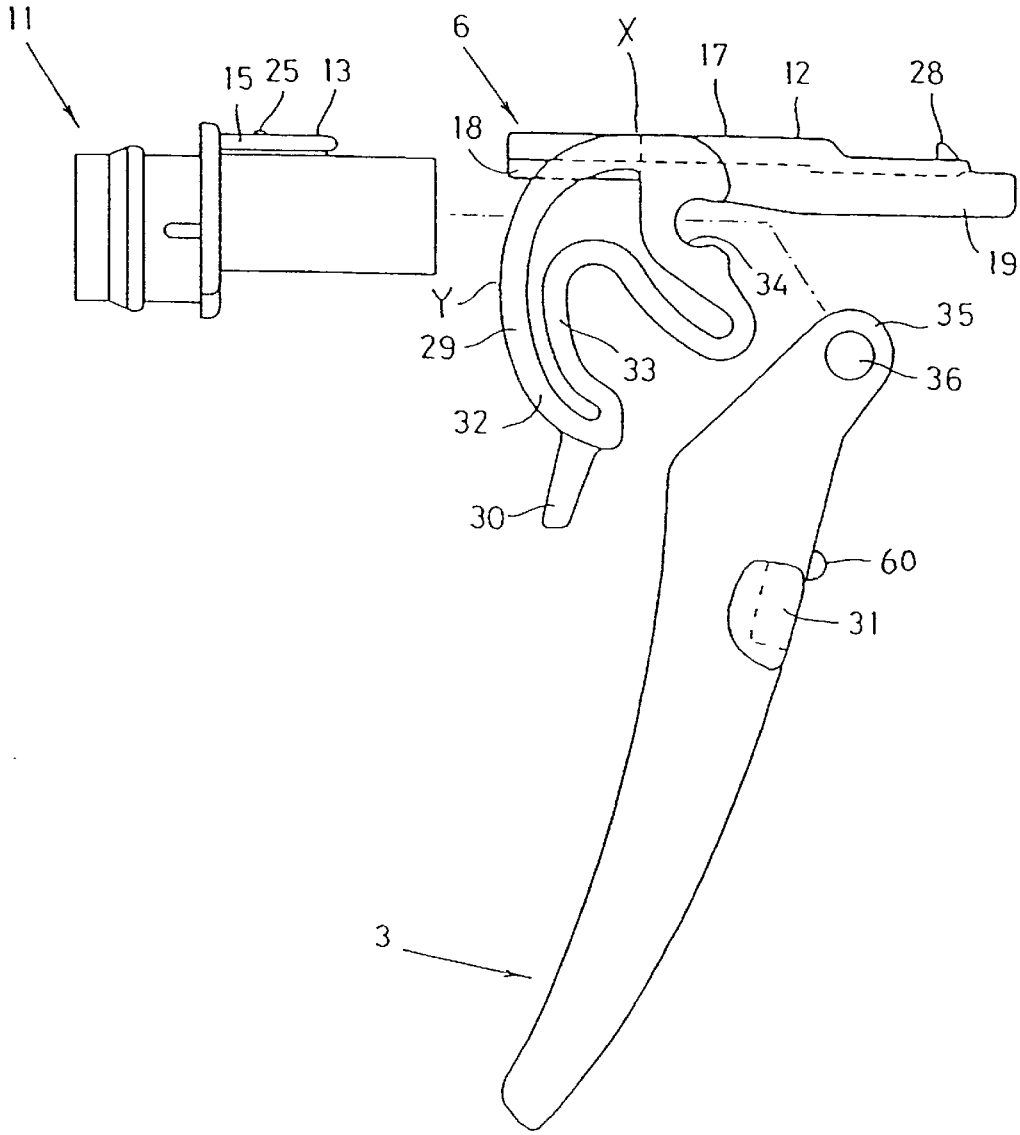
FIG. 4 is a side view of the disassembled state of the trigger, the spring member and the tip member of the trigger type liquid dispenser of FIG. 1.

The trigger 3 is provided with a projection 60 rearwardly (the plunger 5 side) protruded, as illustrated in FIGS. 1, 3 and 4. The plunger 5 of the pump mechanism 4 is provided with a concaved depression 61, as illustrated in FIGS. 1 and 3. The projection 60 of the trigger 3 is engaged with the concaved depression 61 of the plunger 5, so that the plunger 5 is moved forwardly and backwardly together with the trigger 3.

The tip member 11 and the front portion of the base plate 12 of the spring member 6 may be integrally formed, although such embodiment is not illustrated in the drawings. By such construction, the engaging process of the base plate 12 with the tip member 11 can be omitted.

Figure 16:
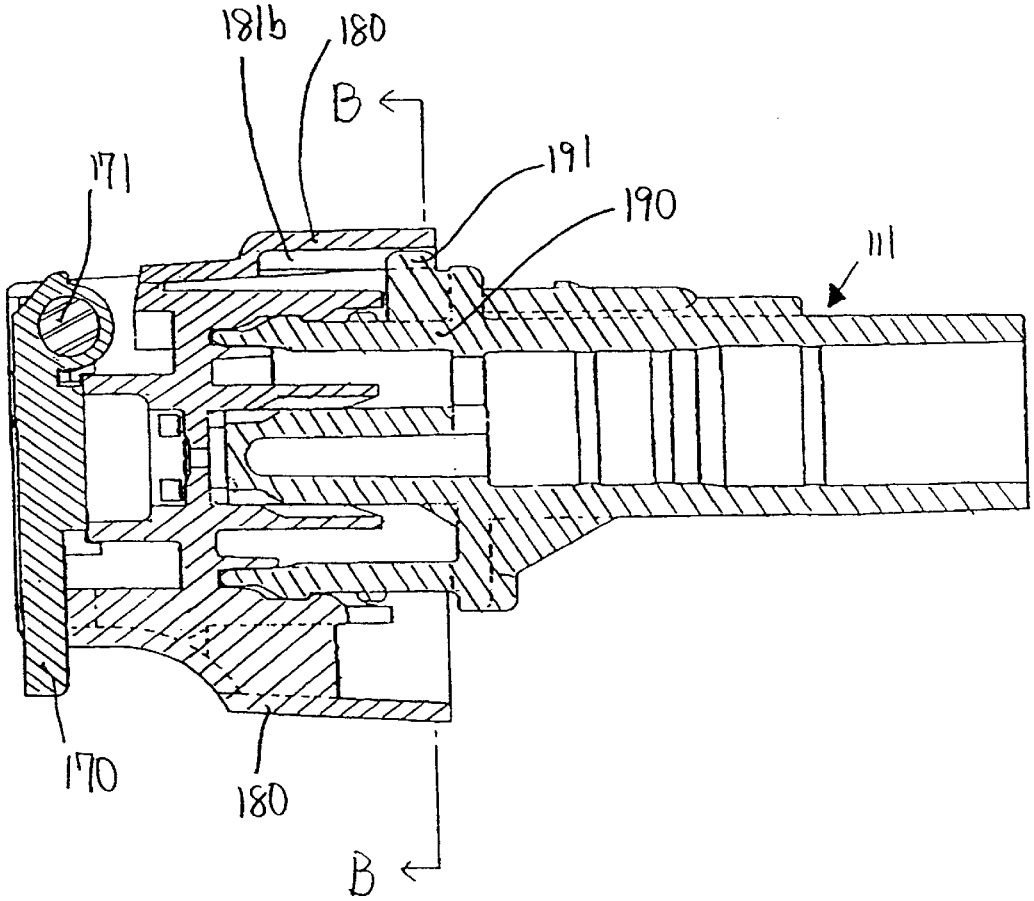
FIG. 16 is a longitudinal sectional view of the nozzle head and the tip element according to the second embodiment of the present invention.
Figure 17:
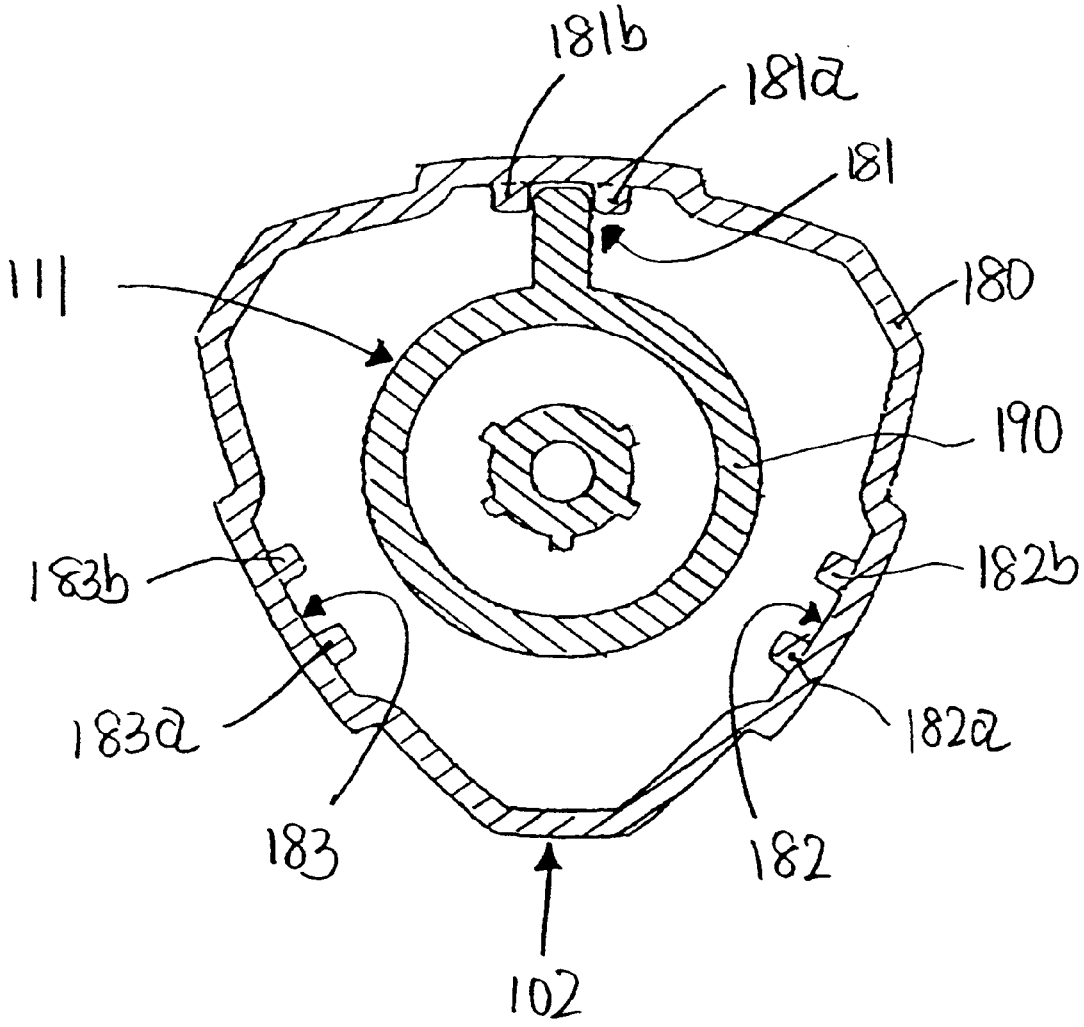
FIG. 17 is an end view taken along B—B line in FIG. 16.

Next, another embodiment of the present invention will be described. This embodiment enables the nozzle head to be positioned precisely with respect to the tip member mounted to the front end of the injection cylinder of the injector body. Referring to FIGS. 16 and 17, said embodiment will be described.

A nozzle head 102 in the illustrated example can change the form of the injected liquid to atomizing, injecting or injecting in the form of foaming. The structure changing the form of liquid is known, and for example, the structure disclosed in the U.S. Pat. No. 4,365,751 can be used. Since the illustrated embodiment can change liquid to three forms, the nozzle head 102 of the illustrated embodiment has a schematic triangular cross section as illustrated in FIG. 17, however, the present invention is not limited thereto. Although the nozzle head 102 in the illustrated embodiment has a lid body 170 which rotates around the shaft 171, however, the present invention is applied also to nozzle heads without a lid body.

The nozzle head 102 has an outer peripheral wall 180. In the illustrated embodiment, three fitting portions 181, 182 and 183 are formed on an inner surface of said outer peripheral wall 180. The positions of said fitting portions 181, 182 and 183 correspond to the structure of the nozzle head changing the form of liquid to atomizing, injecting or injecting in the form of forming. The outer peripheral wall 180 is preferably projected radially outward in and around an area where the fitting portions 181, 182 and 183 are formed.

Each of said fitting portions 181, 182 and 183 is formed by a pair of fitting convex strips a), b) (181*a*, 181*b*, 182*a*, 182*b*, 183*a*, 183*b*). In each fitting portion, the fitting convex strip a) and the fitting convex strip b) are arranged in a predetermined space therebetween.

A tip member 111 includes a cylindrical wall 190, and a fitting projection 191 is formed extending radially outwardly from said cylindrical wall 190. A circumferential width of said fitting projection is substantially same as the predetermined space of said pair of fitting strips.

These tip member and nozzle head are made by molding synthetic resin. The fitting projection 191 of the tip member 111 and the fitting convex strips 181*a*, 181*b*, 182*a*, 182*b*, 183*a*, 183*b* formed on the nozzle head 102 have the elasticity of synthetic resin.

In FIG. 17, the fitting projection 191 of the tip member 111 is fitted into the fitting portion 181. When the nozzle head 102 is rotated clockwise with respect to the tip member 111 in such state, the fitting projection 191 of the tip member 111 is moved over the fitting convex strip 181*a* formed on the nozzle head 102 due to the elasticity of the fitting convex strip 181*a* and the fitting projection 191. When the nozzle head 102 is further rotated, the fitting projection 191 is moved over the fitting convex strip 181*b* formed by the nozzle head 102 and fits into the fitting portion 182 comprising the fitting convex strip 182*a* and the fitting convex strip 182*b*. Since the fitting projection 191 is moved over the fitting convex strip and fits into the fitting portion, the nozzle head 102 can be positioned precisely with respect to the tip member 111. In addition, the movement of the fitting projection 191 over the fitting convex strip provides a click feeling to the user. By such click feeling, the user recognizes that the nozzle head 102 is precisely positioned with respect to the tip member 102.

The present invention is not limited to FIGS. 16 and 17. Moreover, this embodiment is also applicable to trigger-type liquid ejector without the above-described spring member made of synthetic resin.

According to the present invention, the main plate spring is positioned at nozzle head side, has a substantially arcuate longitudinal section, and has a locus of elastic deformation which substantially coincides to an arc locus including a tangent line in an upper surface of the base plate of the spring member. Thus, an internal stress is not concentrate in a part at the time of elastic deformation. Even if the trigger is used above the setting times, a possibility of fatigue breakage is remarkably decreased. In addition, the design freedom can be increased.

As described above, the second plate spring has a longitudinal section which is designed to be a substantially constant-load plate spring. Thus, the rebound resilience of the second plate spring is constant in spite of the amount of the resilient deformation. Thus, the operation feeling of the trigger mainly depends on the spring constant of the main plate spring. In addition, an insufficient spring elasticity of the main plate spring at the time of returning of the trigger can be compensated by the rebound resilience of the second plate spring, even if the trigger is pulled a little. Since the present invention has the advantages as described above, the operation feeling of the trigger and the returning of the trigger and the plunger in the pump mechanism are remarkably improved.

What is claimed is:

1. A trigger-type liquid dispenser comprising an injector body (1) having an inverted L-shaped side shape, a nozzle head (2) mounted at a front end of the injector body (1), a trigger (3) hinged at a front portion of the injector body (1), a pump mechanism (4) in the injector body (1), said pump mechanism (4) including a plunger (5), and a spring member (6), characterized in that the spring member (6) is made of synthetic resin, and comprises a base plate (12) and a pair of spring pieces (29) for returning the plunger (5), each of said spring pieces (29) comprises a main plate spring (32), a second plate spring (33) and a lower end (30), said main plate spring (32) is positioned at nozzle head side, and has a schematically arcuate longitudinal section, said second plate spring (33) is positioned at plunger side, and has a longitudinal section constituting a substantially constant-load plate spring, said main plate spring (32) and said second plate spring (33) are connected each other at an upper end and a lower end (30) thereof, and a locus of elastic deformation of the main plate spring (32) substantially coincides with an arc locus (Y, Z) including a tangent line (X) in an upper surface of the base plate (12).

2. The trigger-type liquid dispenser according to claim 1, wherein the injector body (1) is provided with a front receiving seat (13) and a rear receiving seat (14) on a front and rear portion of an upper surface of the injector body (1), each of the front and rear receiving seats (13, 14) receives a front and rear portion of the base plate (12) of the spring member (6), fit fixing means (21, 22) are provided between the base plate (12) and the receiving seats (13, 14), the trigger (3) is provided with a pair of pockets (31) at a middle portion of both right and left sides of the trigger (3), and each of the lower ends (30) of the spring pieces (29) of the spring member (6) is inserted into each of the pockets (31).

3. The trigger-type liquid dispenser according to claim 2, wherein the injector body (1) includes an injection cylinder (10), a tip member (11) is mounted at a front end of the injection cylinder (10), the front receiving seat (13) is formed on an upper surface of the tip member (11), and the rear receiving seat (14) is formed on an upper surface of a rear portion of the injection cylinder (10).

4. The trigger-type liquid dispenser according to claim 1, wherein the injector body (1) includes an injection cylinder (10), a tip member (11) is mounted at a front end of the injection cylinder (10), the tip member (11) is integrally formed with a front portion of the base plate (12), the injector body (1) is provided with a rear receiving seat (14) on an upper surface of a rear portion of the injection cylinder (10), so as to seat the rear portion of the base plate (12) in the rear receiving seat (14), fit fixing means (22) is provided between the rear portion of the base plate (12) and the rear receiving seat (14), so as to fix the base plate (12) to the injector body (1), the trigger (3) is provided with a pair of pockets (31) at a middle portion of both right and left sides of the trigger (3), and each of the lower ends (30) of the spring pieces (29) of the spring member (6) is inserted into each of the pockets (31).

5. The trigger-type liquid dispenser according to claim 1, wherein the trigger 3 includes a shaft-receiving portion (34) at an upper portion of the second plate spring (33), which upper portion is connected to the base plate (12), and a lower end (30) connecting a lower end of the main plate spring (32) and a lower end of the second plate spring (33) is engaged with the trigger (3).

6. The trigger-type liquid dispenser according to claim 3, wherein the nozzle head (2, 102) is provided with fitting portions (181, 182, 183) on an inner surface thereof, the tip member (11, 111) is provided with a fitting projection (191) extending radially and outwardly, and the fitting projection (191) is engaged with the fitting portions (181, 182, 183).

7. A trigger-type liquid dispenser comprising an injector body (1) having an inverted L-shaped side shape, a nozzle head (2, 102) mounted at a front end of the injector body (1), a trigger (3) hinged at a front portion of the injector body (1), a pump mechanism (4) in the injector body (1), said pump mechanism (4) including a plunger (5), and a spring member (6), characterized in that the injector body (1) includes an injection cylinder (10), a tip member (11) is mounted at a front end of the injection cylinder (10), the nozzle head (2, 102) is provided with fitting portions (181, 182, 183) on an inner surface thereof, the tip member (11, 111) is provided with a fitting projection (191) extending radially and outwardly, and the fitting projection (191) is engaged with the fitting portions (181, 182, 183).

8. The trigger-type liquid dispenser according to claim 7, wherein each of said fitting portions 181, 182, 183) comprises a pair of fitting convex strips (181*a*, 181*b*, 182*a*, 182*b*, 183*a*, 183*b*).

* * * * *